US007828228B2

(12) United States Patent
Mochizuki et al.

(10) Patent No.: US 7,828,228 B2
(45) Date of Patent: Nov. 9, 2010

(54) FUEL INJECTION APPARATUS

(75) Inventors: Kouichi Mochizuki, Anjo (JP); Masatoshi Kuroyanagi, Kariya (JP); Tatsushi Nakashima, Anjo (JP)

(73) Assignee: Denso Corporation, Kariya (JP)

( * ) Notice: Subject to any disclaimer, the term of this patent is extended or adjusted under 35 U.S.C. 154(b) by 179 days.

(21) Appl. No.: 12/345,700

(22) Filed: Dec. 30, 2008

(65) Prior Publication Data

US 2009/0179088 A1 Jul. 16, 2009

(30) Foreign Application Priority Data

Jan. 10, 2008 (JP) ..... 2008-003411

(51) Int. Cl.
*B05B 1/08* (2006.01)

(52) U.S. Cl. ..... 239/102.2; 239/69

(58) Field of Classification Search ..... 239/66, 239/69, 102.1, 102.2, 585.1, 585.3, 585.4, 239/585.5, 533.2, 584, 585.2; 251/127, 129.15, 251/129.21

See application file for complete search history.

(56) References Cited

U.S. PATENT DOCUMENTS 5,779,149 A * 7/1998 Hayes, Jr. ..... 239/124
5,979,803 A * 11/1999 Peters et al. ..... 239/533.4
6,079,641 A * 6/2000 Shinogle et al. ..... 239/533.4
6,820,820 B1 * 11/2004 Boecking ..... 239/102.2
2003/0226905 A1 * 12/2003 Cotton et al. ..... 239/102.2
2003/0226990 A1 * 12/2003 Waterfield ..... 251/129.06
2007/0152084 A1 7/2007 Boecking
2008/0245891 A1 10/2008 Mochizuki et al.

FOREIGN PATENT DOCUMENTS

JP 10-176624 6/1998
JP 10-306756 11/1998
JP 11-200981 7/1999

* cited by examiner

*Primary Examiner*—Davis Hwu
(74) *Attorney, Agent, or Firm*—Nixon & Vanderhye PC

(57) ABSTRACT

An inflection point sensing arrangement of an electronic drive unit, which drives a fuel injection valve, senses an inflection point in a pressure-changing process of the pressure in the control chamber. A charging and discharging condition changing arrangement of the electronic drive unit changes a charging condition for charging of the electric current to a piezoelectric actuator of the fuel injection valve or a discharging condition for discharging of the electric current from the piezoelectric actuator upon sensing of the inflection point, which is sensed with the inflection point sensing arrangement.

12 Claims, 11 Drawing Sheets

FUEL INJECTION APPARATUS

CROSS REFERENCE TO RELATED APPLICATION

This application is based on and incorporates herein by reference Japanese Patent Application No. 2008-003411 filed on Jan. 10, 2008.

BACKGROUND OF THE INVENTION

1. Field of the Invention

The present invention relates to a fuel injection apparatus, which includes a piezoelectric actuator as a drive source and injects high pressure fuel.

2. Description of Related Art

Lately, it has been demanded to adjust a fuel injection quantity (amount) at a high accuracy and to achieve a quick operational response in a fuel injection apparatus, which injects high pressure fuel in a cylinder of an internal combustion engine of a vehicle (e.g., an automobile) to reduce emissions in exhaust gas or to improve fuel consumption. In order to meet the demand of the improved fuel injection accuracy and the improved operational response in the fuel injection apparatus, there have proposed various fuel injection apparatuses, which have a piezoelectric actuator of a larger force and of a further improved operational response.

WO2005/075811A1 (corresponding to US 2007/0152084A1) teaches a fuel injection valve (injector), which injects fuel into a cylinder of an internal combustion engine. The fuel injection valve includes an injector base body, a nozzle holder and a valve element. The valve element is slidably received in the nozzle holder and has a seat surface, which is adapted to open or close a fuel injection hole. A piezoelectric actuator drives the injection valve element. More specifically, the piezoelectric actuator drives a first piston, which receives a second piston that is connected to the injection valve element.

JPH11-200981A teaches a fuel injection valve and a drive method thereof In the fuel injection valve, a first pressure receiving surface, which is directed downward and is formed by a step between a first guide shaft and a second guide shaft of a needle 15, is communicated with or is disposed in a control pressure chamber, a pressure of which is changed depending of displacement of an electrostrictive actuator. The voltage, which is applied to the electrostrictive actuator, is changed several times within one injection time period to change a fuel injection rate, which is determined by the lift amount of the needle, several times within the one injection time period.

In the prior art fuel injection apparatus, which uses the piezoelectric actuator, the pressure, which is applied to the piezoelectric actuator, changes in response to the drive movement of the needle, so that a voltage is generated in a direction opposite to that of the drive voltage due to the piezoelectric effect. In this way, the drive speed of the fuel injection apparatus may possibly be slowed down to cause a reduction in the response speed and a reduction in the fuel injection accuracy.

SUMMARY OF THE INVENTION

The present invention addresses the above disadvantages.

According to the present invention, there is provided a fuel injection apparatus, which includes a nozzle, a needle, a control chamber, a piezoelectric actuator, an inflection point sensing means and a charging and discharging condition changing means. The nozzle has a fuel injection hole and a valve seat. The fuel injection hole extends through a wall of a distal end portion of the nozzle, and the valve seat surrounds an inlet of the fuel injection hole. The needle has a valve element at a distal end side of the needle and is axially reciprocable in a first axial direction and an opposite second axial direction relative to the valve seat. The control chamber receives pressure conducting fluid, which exerts a pressure to the needle to axially drive the needle. The piezoelectric actuator expands and contracts depending on a drive voltage thereof, which is increased and is decreased through charging of electric current to the piezoelectric actuator and discharging of electric current from the piezoelectric actuator, respectively. One of expansion and contraction of the piezoelectric actuator results in an increase in the pressure of the pressure conducting fluid in the control chamber to axially move the needle in the first axial direction away from the valve seat, and the other one of the expansion and the contraction of the piezoelectric actuator results in a decrease in the pressure of the pressure conducting fluid in the control chamber to axially move the needle in the second axial direction toward the valve seat. The inflection point sensing means is for sensing an inflection point in a pressure-changing process of the pressure in the control chamber. The charging and discharging condition changing means is for changing a charging condition for the charging of the electric current to the piezoelectric actuator or a discharging condition for the discharging of the electric current from the piezoelectric actuator upon sensing of the inflection point, which is sensed with the inflection point sensing means.

BRIEF DESCRIPTION OF THE DRAWINGS

The invention, together with additional objectives, features and advantages thereof, will be best understood from the following description, the appended claims and the accompanying drawings in which:

DETAILED DESCRIPTION OF THE INVENTION

Figure 1:
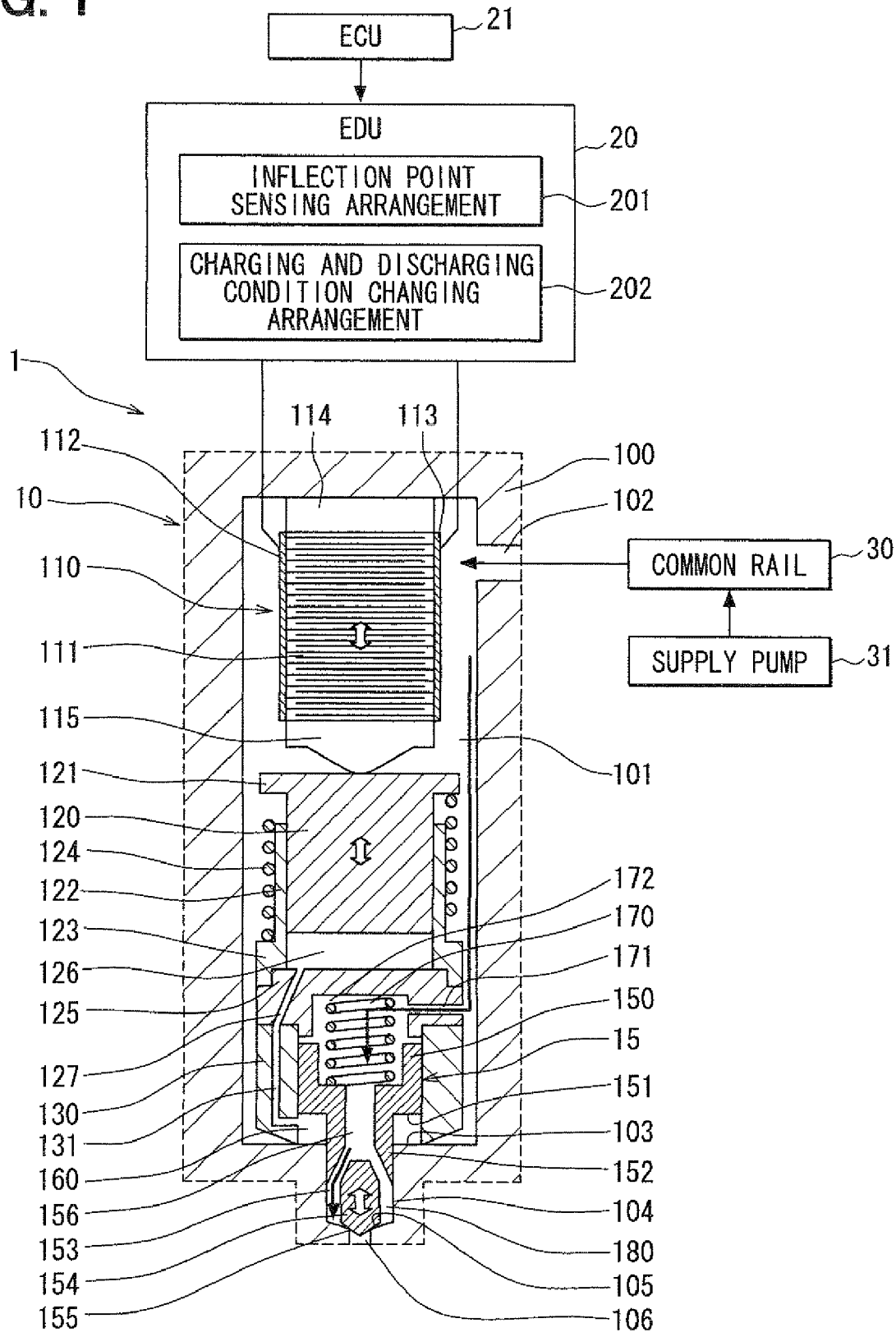
FIG. 1 is a schematic view showing an entire structure of a fuel injection apparatus according to a first embodiment of the present invention.

An entire structure of a fuel injection apparatus 1 according to a first embodiment of the present invention will be described with reference to FIG. 1. In the following description, an upper side of the drawing will be referred to as a proximal end side, and a lower side in the drawing will be referred to as a distal end side.

The fuel injection apparatus 1 is provided in an internal combustion engine (not shown) and includes a supply pump (high pressure pump) 31, a fuel injection valve 10 and an electronic control unit (ECU) 21. The supply pump 31 pressurizes fuel and provides the pressurized fuel to a common rail 30 where the pressurized fuel is accumulated. The fuel injection valve 10 receives the high pressure fuel from the common rail 30 and injects the received high pressure fuel into a combustion chamber of the corresponding cylinder of the internal combustion engine. The ECU 21 computes the appropriate fuel injection amount, the appropriate fuel injection timing and the appropriate fuel injection pressure based on measurement signals of various sensors (not shown) and supplies a corresponding drive signal to an electronic drive unit (EDU) 20. Furthermore, the ECU 21 controls the operations of the common rail 30, the supply pump 31 and the fuel injection valve 10.

In the fuel injection valve 10, a piezoelectric actuator 110, which is received in a generally cylindrical fuel injection valve base body 100, serves as a drive source. Specifically, the piezoelectric actuator 110 expands and contracts in response to an applied voltage (drive voltage). The expansion or contraction (displacement) of the piezoelectric actuator 110 is transmitted to a pressurizing piston 120 to axially displace the pressurizing piston 120 and thereby to increase or decrease the pressure $P_S$ in a control chamber 160. Then, in response to the increase or decrease in the pressure $P_S$, a needle 15 is axially driven upward or downward, so that a valve element 154, which is provided at a distal end of the needle 15, opens or closes a fuel injection hole 106 to start or stop injection of the high pressure fuel guided into the fuel injection valve 10.

The fuel injection valve base body 100 is configured into the generally cylindrical body that has a fuel flow passage 101 therein, and a proximal end side of the fuel flow passage 101 is closed or sealed.

A high pressure fuel inlet hole 102 is formed at the proximal end side of the fuel injection valve base body 100 to receive the high pressure fuel, which is accumulated in the common rail 30.

In a base body diameter transition portion 103 at the distal end side of the fuel injection valve base body 100, an inner diameter of the fuel flow passage 101 is reduced to form a nozzle 104. Furthermore, the inner diameter of the fuel flow passage 101 is further reduced at a distal end side of the nozzle 104 to form a valve seat 105, at which the injection hole 106 extends therethrough to open in the cylinder of the engine in such a manner that the valve seat 105 surrounds an inlet of the injection hole 106.

The piezoelectric actuator 110 is made of a piezoelectric ceramic material, such as PZT (lead zirconate titanate), and includes a laminated piezoelectric element 111, in which tens or hundreds of piezoelectric ceramic layers, each of which is polarized in the thickness direction thereof, are axially stacked one after another. Here, each two adjacent piezoelectric layers have different polarization directions, respectively.

An internal electrode is formed between each adjacent piezoelectric ceramic layers of the laminated piezoelectric element 111. One of each adjacent two internal electrodes is pulled out on the left side and is connected to a lateral surface electrode 112, and the other one of each adjacent two internal electrodes is pulled out on the right side and is connected to a lateral surface electrode 113. Then, the left and right lateral surface electrodes 112, 113 are connected to the EDU 20.

The piezoelectric actuator 110 is received in the fuel injection valve base body 100. An upper end surface of a proximal end side protective layer 114, which is formed at the proximal end side of the piezoelectric actuator 110, contacts an inner peripheral surface of the fuel injection valve base body 100 while the upper end surface of the proximal end side protective layer 114 maintains an electrical insulation relative to the fuel injection valve base body 100. A lower end surface of a distal end side protective layer 115, which is formed at the distal end side of the piezoelectric actuator 110, contacts the pressurizing piston 120, which is coaxial to the piezoelectric actuator 110.

The pressurizing piston 120 is configured into a generally cylindrical form and has a piston flange 121, which is formed at the proximal end side of the pressurizing piston 120 and radially outwardly projects. The pressurizing piston 120 is slidably held in a piston guide cylinder 122, which is configured into a generally cylindrical form.

A cylinder flange 123 is formed at the distal end side lower end of the piston guide cylinder 122 to project radially outward. A piston return spring 124 is placed between the piston flange 121 and the cylinder flange 123 to urge the piston 120 toward the piezoelectric actuator 110.

A partition wall 125 is placed on the distal end side of the piston guide cylinder 122. A pressurizing chamber 126 is defined by a lower end surface of the piston 120, an inner peripheral wall of the piston guide cylinder 122 and an upper surface of the partition wall 125. A portion of the high pressure fuel, which is guided into the fuel injection valve base body 100, is supplied into the pressurizing chamber 126 as pressure conducting medium (also referred to as pressure conducting fluid).

The needle 15 has a needle large diameter portion 150, a first diameter transition portion 151, a needle small diameter portion 152, a second diameter transition portion 153 and the valve element 154. The needle large diameter portion 150 has a relatively large diameter and is formed at the proximal end side of the needle 15. The needle small diameter portion 152 has a relatively small diameter in comparison to that of the needle large diameter portion 150 and is located on the distal end side of the needle large diameter portion 150. The first diameter transition portion 151 connects between the needle large diameter portion 150 and the needle small diameter portion 152. The second diameter transition portion 153 is located on the distal end side of the needle small diameter portion 152 and has a further smaller diameter, which is smaller than that of the needle small diameter portion 152. The valve element 154 is located on the distal end side of the second diameter transition portion 153. A valve element seat surface 155 is formed in a distal end surface of the valve element 154 and is adapted to engage and disengage the inner peripheral wall of the valve seat 105 depending on the operational position of the needle 15.

An insert cylinder 130 is configured into a generally cylindrical form and is placed on the distal end side of the partition wall 125. The needle large diameter portion 150 is slidably held by the insert cylinder 130 at radially inward of the insert cylinder 130. The needle small diameter portion 152 is slidably held by the nozzle 104 at radially inward of the nozzle 104. The control chamber 160 is defined by the inner peripheral wall of the insert cylinder 130, a bottom surface of the first diameter transition portion 151 and the upper inner wall surface of the base body diameter transition portion 103. The inner diameter of the upper inner wall surface of the base body diameter transition portion 103 is reduced from the fuel flow passage 101 toward the nozzle 104.

A fuel accumulation chamber 180 is defined by the outer peripheral surface of the second diameter transition portion 153, the outer peripheral surface of the valve element 154 and the inner peripheral wall of the nozzle 104.

A communication flow passage 127 is formed in the partition wall 125, and a communication passage 131 is formed in the insert cylinder 130. These communication passages 127, 131 are connected with each other to communicate between the pressurizing chamber 126 and the control chamber 160. The pressure in the pressurizing chamber 126 is conducted to the control chamber 160 through the communication passages 127, 131 by means of the high pressure fuel, which is supplied as the pressure conducting medium.

A back pressure chamber 170 is defined by a back surface of the needle 15, a distal end side bottom surface of the partition wall 125 and an inner peripheral wall of the insert cylinder 130.

A back pressure supply flow passage 171, which communicates between the fuel flow passage 101 and the back pressure chamber 170, is formed in the partition wall 125. The high pressure fuel in the fuel flow passage 101 is supplied to the back pressure chamber 170.

The back pressure chamber 170 is provided to the back surface of the needle 15 and serves as a spring chamber which receives a back pressure spring 172 that urges the needle 15 in a valve closing direction thereof (the direction toward the valve seat 105).

A needle internal flow passage 156 is formed in the needle 15 to communicate between the back pressure chamber 170 and the fuel accumulation chamber 180.

The pressure in the control chamber 160 is exerted against a bottom surface of the first diameter transition portion 151 in a valve opening direction (the direction away from the valve seat 105). A spring pressure of the back pressure spring 172 is exerted in the valve closing direction of the needle 15.

The pressure in the back pressure chamber 170 is exerted against the back surface of the needle 15 in the valve closing direction. The pressure in the fuel accumulation chamber 180 is exerted against a bottom surface of the second diameter transition portion 153 in the valve opening direction and is balanced with the pressure in the back pressure chamber 170.

The piezoelectric actuator 110 is expanded or contracted depending on the charging or discharging of the electric charge applied from the EDU 20 to the piezoelectric actuator 110. When the piezoelectric actuator 110 is expanded or contracted, the pressurizing piston 120 is axially driven downward or upward to increase or decrease the pressure in the pressurizing chamber 126. Through the increase or decrease of the pressure in the pressurizing chamber 126, the pressure $P_S$ in the control chamber 160 is increased or decreased.

When the pressure $P_S$ in the control chamber 160 becomes equal to or larger than the spring pressure of the back pressure spring 172, the needle 15 is moved upward in the valve opening direction. Thus, the valve element seat surface 155 is disengaged from the inner peripheral wall of the valve seat 105, so that the injection hole 106 is opened, and thereby the high pressure fuel in the fuel accumulation chamber 180 is injected into the cylinder of the engine through the injection hole 106.

When the pressure $P_S$ in the control chamber 160 becomes smaller than the spring pressure of the back pressure spring 172, the needle 15 is moved downward in the valve closing direction. Thus, the valve element seat surface 155 is engaged with the inner peripheral wall of the valve seat 105, so that the injection hole 106 is closed, and thereby the injection of the high pressure fuel from the fuel accumulation chamber 180 through the injection hole 106 is stopped.

Figure 2A:
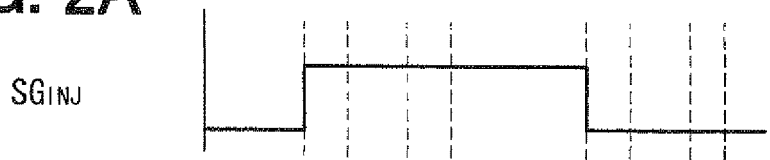
FIGS. 2A to 2F are diagrams for describing an operation of the fuel injection apparatus of the first embodiment.
Figure 2B:
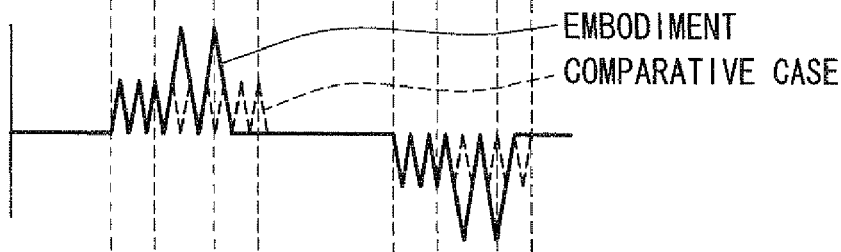
Figure 2C:
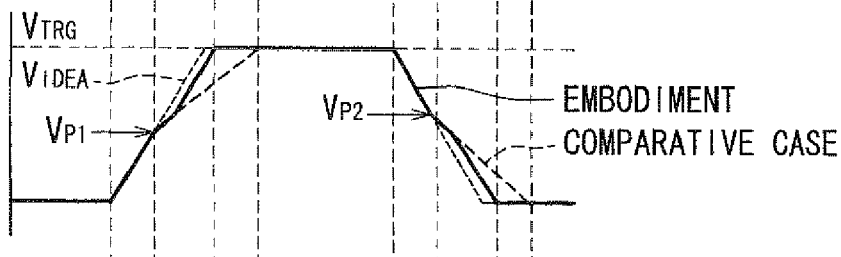
Figure 2D:
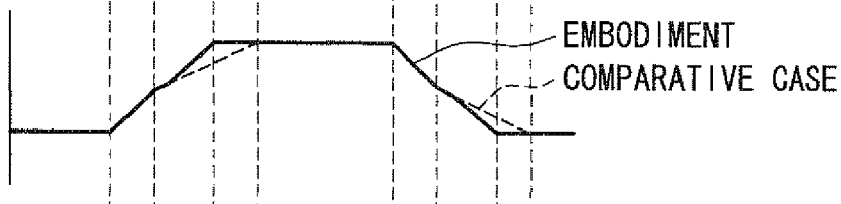
Figure 2E:
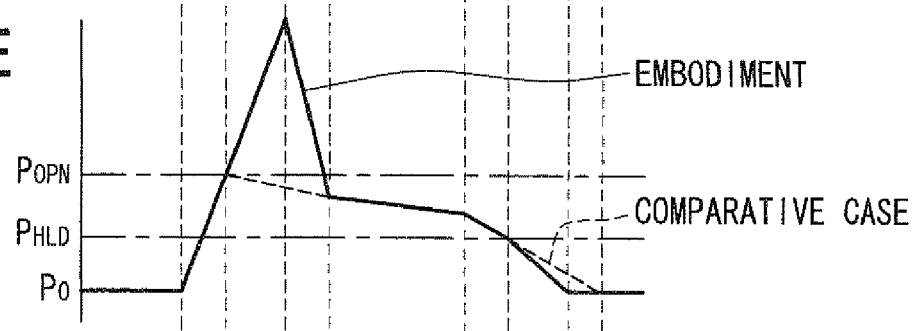
Figure 2F:
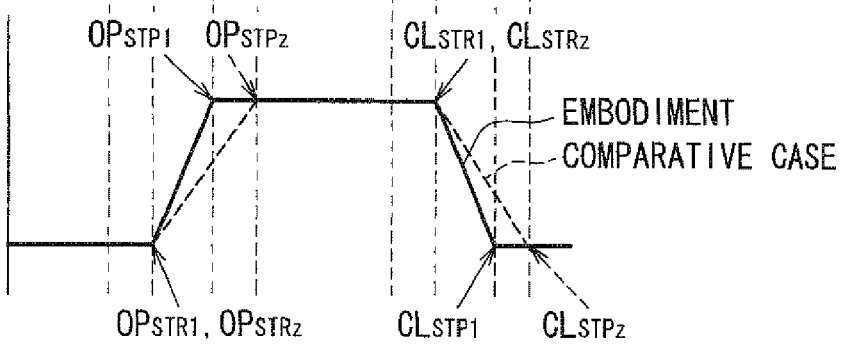

Advantages of the present invention will be described with reference to FIGS. 2A to 2F. FIGS. 2A to 2F show an example of a time chart for the opening and closing of the fuel injection valve 10. Specifically, FIG. 2A indicates the change in the fuel injection valve drive signal $SG_{INJ}$ of the ECU 21 with the time. In FIG. 2B, a solid line indicates the change in the drive current $I_P$ with the time in the case of executing the exemplary control operation of the present embodiment, and a dotted line indicates the change in the drive current $I_P$ with the time in the case of executing the control operation of a previously proposed fuel injection apparatus in a comparative case. Furthermore, in FIG. 2C, a solid line indicates the change in the piezoelectric voltage $V_P$ with the time according to the present embodiment, and a dotted line indicates the change in the piezoelectric voltage $V_P$ with the time according to the comparative example. Also, in FIG. 2D, a solid line indicates the change in the displacement amount $X_P$ of the piezoelectric actuator according to the present embodiment, and a dotted line indicates the change in the displacement $X_P$ of the piezoelectric actuator according to the comparative case. Furthermore, in FIG. 2E, a solid line indicates the change in the control chamber internal pressure $P_S$ with the time according to the present embodiment, and a dotted line indicates the change in the control chamber internal pressure $P_S$ with the time according to the comparative case. In addition, in FIG. 2F, a solid line indicates the change in the needle lift amount $X_N$ with the time according to the present embodiment, and a dotted line indicates the change in the needle lift amount $X_N$ with the time according to the comparative case.

The data, which indicates the operational state, is supplied from the various sensors (not shown) to the ECU 21. Then, the fuel injection condition, which corresponds to the current operational state, is determined by the ECU 21, so that the ECU 21 supplies the fuel injection valve drive signal $SG_{INJ}$ to the EDU 20. Then, the EDU 20 charges or discharges the drive current $I_P$ relative to the piezoelectric actuator 110 at a predetermined pulse period.

When the valve opening command is received, the pulsed current of the constant pulse period t0 is charged to the piezoelectric actuator 110 as the charge current $I_P$. Thereby, due to the inverse piezoelectric effect, the piezoelectric actuator 110 is expanded to press the pressurizing piston 120. At this time, the piezoelectric actuator 110 receives the reaction force from the pressurizing piston 120 in the compressing direction (in the upward direction in FIG. 1), so that the voltage is generated in the same direction as that of the piezoelectric voltage $V_P$ due the piezoelectric effect.

By repeating the above process, the piezoelectric voltage $V_P$ is increased in the superimposed manner (cumulative manner). Thereby, the displacement amount $X_P$ of the piezoelectric actuator 110 from the initial position (uncharged state) is increased in response to the increase in the piezoelectric voltage $V_P$. When the piezoelectric actuator 110 is expanded, the pressurizing piston 120 is moved downward. Thus, the pressure $P_S$ in the control chamber 160 is increased. When the pressure $P_S$ in the control chamber 160 becomes equal to or larger than the spring pressure of the back pressure spring 172, i.e., when the pressure $P_S$ in the control chamber 160 becomes equal to or larger than the valve opening pressure $P_{OPN}$, the needle 15 begins to move upward.

When the needle 15 begins to move upward, the volume of the control chamber 160 is increased. Thus, the pressure $P_S$ in the control chamber 160 is instantaneously reduced. Thereby, the pressure, which is exerted to the piezoelectric actuator 110, is reduced. Thus, due to the piezoelectric effect, the voltage, which is applied in the direction opposite to that of the charging voltage, is generated to possibly cause the slowdown of the drive movement of the piezoelectric actuator 110.

In view of this, according to the present embodiment, there is provided an inflection point sensing arrangement (serving as an inflection point sensing means) 201, which senses a change in the pressure $P_S$ in the control chamber 160. The inflection point sensing arrangement 201 is used to sense, i.e., to identify an inflection point (also referred to as a point of inflection), which occurs in the pressure-changing process of the pressure in the control chamber 160. For example, the inflection point may possibly be a point, at which the slope of the change of the measured value or the rate of change of the measured value is substantially shifted from the previous one or from its target value. Upon the sensing of the inflection point with the inflection point sensing arrangement 201, a charging and discharging condition changing arrangement (serving as a charging and discharging condition changing means) 202 is used to rapidly increase the charging current $I_P$, so that it is possible to make a modification to achieve a state, which is equal to or close to a state of an ideal charging voltage $V_{IDEA}$.

In the present embodiment, the inflection point sensing arrangement 201 is provided in a form of a drive voltage measurement circuit, which measures the piezoelectric voltage $V_P$ of the piezoelectric actuator 110, in the EDU 20. The inflection point sensing arrangement 201 monitors a short-time change (a temporal derivative) $dV_P/dt$ in the changing process of the piezoelectric voltage $V_P$, which corresponds to or reflects a short-time change (a temporal derivative) in the pressure-changing process of the pressure in the control chamber 160, to identify the inflection point in the changing process of the piezoelectric voltage $V_P$ and thereby the inflection point in the changing process of the pressure in the control chamber 160.

When the inflection point sensing arrangement 201 senses the inflection point in the short-time change $dV_P/dt$, the charging and discharging condition changing arrangement 202 changes the charging condition of the piezoelectric actuator 110 in such a manner that the charging voltage $V_P$ is increased, i.e., the pulse period of the charging current $I_P$ is increased. The inflection point sensing arrangement 201 and the charging and discharging condition changing arrangement 202 will be described in more detail later with reference to FIGS. 4 and 5.

When the pulse period of the charging current $I_P$ is increased, the charging voltage is increased to compensate the reduction in the charging voltage caused by the reduction in the pressure $P_S$ in the control chamber 160 at the early stage. Therefore, even after the unseating of the needle 15, i.e., disengagement of the needle 15 from the inner peripheral wall of the valve seat 105, the increasing of the piezoelectric voltage $V_P$ is not substantially limited or hindered.

Therefore, even after the pressure $P_S$ in the control chamber 160 becomes equal to or larger than the valve opening pressure $P_{OPN}$, the pressure $P_S$ in the control chamber 160 is kept increased to rapidly move the needle 15 upward. As a result, the injection hole 106 can be rapidly and fully released, i.e., can be rapidly and fully opened, and thereby the injection of the high pressure fuel through the injection hole 106 can be started rapidly and is stabilized rapidly.

In contrast, when the valve closing command is received, the pulsed current of the constant pulse period is discharged from the piezoelectric actuator 110. Thereby, due to the inverse piezoelectric effect, the piezoelectric actuator 110 is contracted to reduce the pressure, which presses the pressurizing piston 120. As a result, the pressurizing piston 120 begins to move upward due to the force of the piston return spring 124.

At this time, the compression force, which is applied from the pressurizing piston 120 to the piezoelectric actuator 110, is reduced, so that the piezoelectric actuator 110 discharges the voltage, which is applied in the same direction as that of the piezoelectric voltage $V_P$.

By repeating the above process, the piezoelectric voltage $V_P$ is reduced in the superimposed manner. Thereby, the displacement amount $X_P$ of the piezoelectric actuator 110 is reduced in response to the decrease in the piezoelectric voltage $V_P$. When the piezoelectric actuator 110 is contracted, the pressurizing piston 120 is moved upward. Thus, the pressure $P_S$ in the control chamber 160 is reduced. When the pressure $P_S$ in the control chamber 160 becomes smaller than the valve opening maintaining pressure $P_{HLD}$, the needle 15 begins to move downward.

At this time, the volume of the control chamber 160 is reduced, and the pressure $P_S$ in the control chamber 160 is instantaneously increased. Thereby, the pressure, which is exerted to the piezoelectric actuator 110, is increased. Thus, due to the piezoelectric effect, the voltage, which is applied in the direction opposite to that of the discharging voltage, is generated to possibly cause the slowdown of the drive movement of the piezoelectric actuator 110.

In view of this, the inflection point sensing arrangement 201 is used to sense the inflection point, which occurs at the time of occurrence of the change in the pressure $P_S$ in the control chamber 160. Then, upon the sensing of the inflection point with the inflection point sensing arrangement 201, the charging and discharging condition changing arrangement 202 is used to rapidly increase the discharging current $I_P$, so that it is possible to make the modification to achieve the state of the desired discharging voltage.

The reduction in the piezoelectric voltage $V_P$, which is caused by the increase in the pressure $P_S$ in the control chamber 160, is compensated at the early stage by the increase in the discharging current $I_P$. Thereby, even after the seating of the needle 15, i.e., the engagement of the needle 15 against the inner peripheral wall of the valve seat 105, the decreasing of the piezoelectric voltage $V_P$ is not limited or hindered. Thus, even after the pressure $P_S$ in the control chamber 160 becomes smaller than the valve opening maintaining pressure $P_{HLD}$, the pressure $P_S$ in the control chamber 160 is kept decreased. Thereby, the needle 15 is rapidly moved downward to close the injection hole 106 to rapidly stop the injection of the high pressure fuel through the injection hole 106.

According to the present embodiment, the response time period, which is from the valve opening start time point $OP_{STR1}$ to the valve opening completion time point $OP_{STP1}$ (the operational time period of lifting the valve element from the valve seat), is shortened in comparison to the response Lime period, which corresponds to the Valve opening start time point $OP_{STRz}$ to the valve opening completion time point $OP_{STPz}$ in the case of the previously proposed fuel injection apparatus of the comparative case. Furthermore, according to the present embodiment, the response time period, which is from the valve closing start time point $CL_{STR1}$ to the valve closing completion time point $CL_{STP1}$ (the operational time period of seating the valve element against the valve seat), is shortened in comparison to the response time period, which is from the valve closing start time point $CL_{STRz}$ to the valve closing completion time point $CL_{STPz}$ in the case of the previously proposed fuel injection apparatus of the comparative case.

Thus, the response of the needle 15 is improved, and thereby the fuel injection accuracy of the high pressure fuel is improved. As a result, the reliability of the fuel injection apparatus 1 is improved according to the present embodiment.

Now, the disadvantages of the previously proposed fuel injection apparatus of the comparative case will be described with reference to FIGS. 3A to 3F, which are similar to FIGS. 2A to 2F, respectively.

In the previously proposed fuel injection apparatus, the charging and discharging of the drive current $I_P$ of the piezoelectric actuator are executed at the constant pulse period t0.

In the process, which is from the time right after the start of the driving of the needle 15 in the valve opening direction to the time of valve opening, the volume of the control chamber 160 is increased in response to the upward movement of the needle 15, and thereby the increase in the pressure $P_S$ in the control chamber 160 is limited.

Figure 3A:
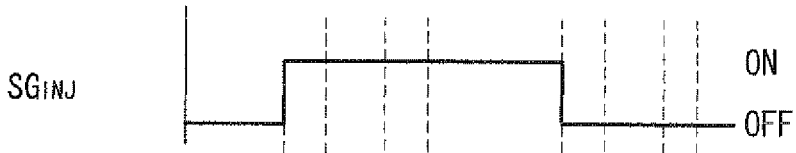
FIG. 3A RELATED ART
FIGS. 3A to 3F are diagrams for describing an operation of a previously proposed fuel injection apparatus.
Figure 3B:
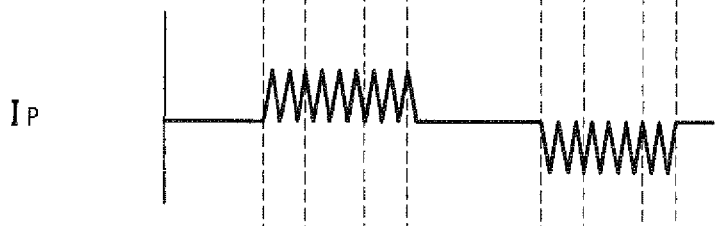
FIG. 3B RELATED ART
Figure 3C:
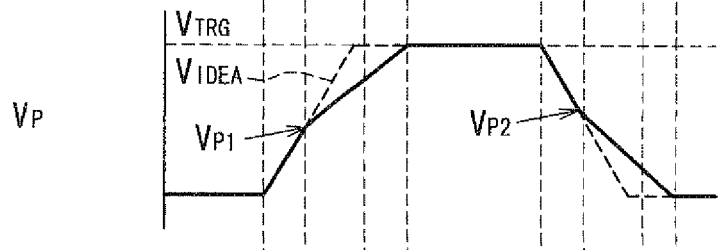
FIG. 3C RELATED ART
Figure 3D:
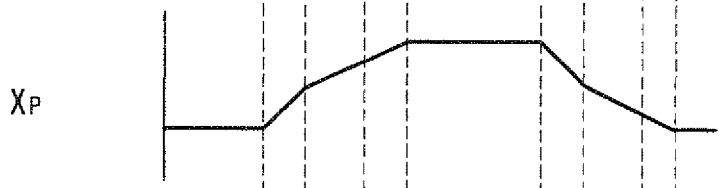
FIG. 3D RELATED ART
Figure 3E:
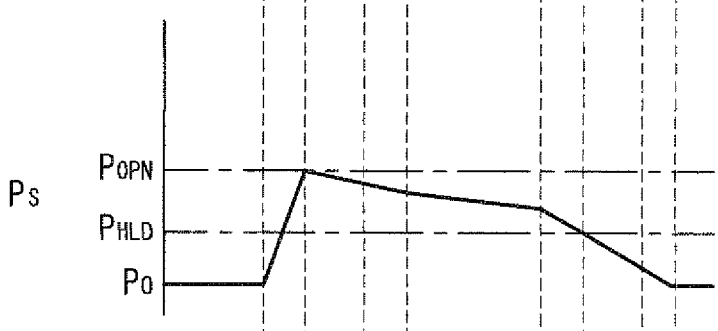
FIG. 3E RELATED ART
Figure 3F:
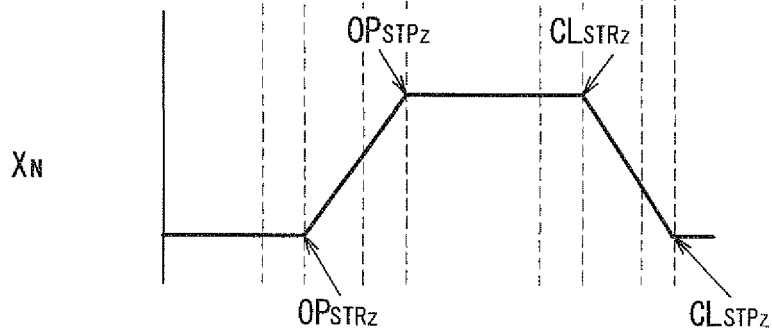
FIG. 3F RELATED ART

Therefore, the pressure, which is applied to the piezoelectric actuator 110, is decreased. At this time, the voltage is generated in the opposite direction, which is opposite from that of the charging voltage due to the piezoelectric effect. Thus, as indicated in FIG. 3C, the inflection point $V_{P1}$ is generated on the rising edge of the changing process of the piezoelectric voltage $V_P$. Therefore, in comparison to the ideal piezoelectric voltage $V_{IDEA}$, the rise of the piezoelectric voltage $V_P$ after the inflection point $V_{P1}$ is slowed down. Therefore, the expansion speed of the displacement amount $X_P$ of the piezoelectric actuator 110 is also slowed down.

As a result, the time period, which is from the valve opening start time point $OP_{STRz}$ to the valve opening completion time point $OP_{STPz}$, is lengthened in the comparative case.

Furthermore, in the process, which is from the time right after the start of the driving of the needle 15 in the valve closing direction to the time of valve closing, the volume of the control chamber 160 is decreased in response to the downward movement of the needle 15, and thereby the decrease in the pressure $P_S$ in the control chamber 160 is limited. At this time, the voltage is generated in the opposite direction, which is opposite from that of the discharging voltage, due to the piezoelectric effect. Thus, as shown in FIG. 3C, the inflection point $V_{P2}$ is generated on the falling edge of the changing process of the piezoelectric voltage $V_P$. Therefore, in comparison to the ideal piezoelectric voltage $V_{IDEA}$, the fall of the piezoelectric voltage $V_P$ after the inflection point $V_{P2}$ is slowed down. Therefore, the contraction speed of the displacement amount $X_P$ of the piezoelectric actuator 110 is also slowed down.

As a result, the time period, which is from the valve closing start time point $CL_{STRz}$ to the valve closing completion time point $CL_{STPz}$, is lengthened in the comparative case.

As discussed above, in the case of the previously proposed fuel injection apparatus of the comparative case, in which the charging and discharging of the voltage are executed at the constant pulse period, the increase or decrease of the piezoelectric voltage $V_P$ is deviated from the ideal state (the ideal piezoelectric voltage $V_{IDEA}$) due to the change in the pressure in the control chamber at the time of executing the valve opening or valve closing.

With reference to FIGS. 4A to 4D and 5, the inflection point sensing arrangement 201 and the charging and discharging condition changing arrangement to 202 will now be described.

Figures 4A, 4B, 4C, 4D:
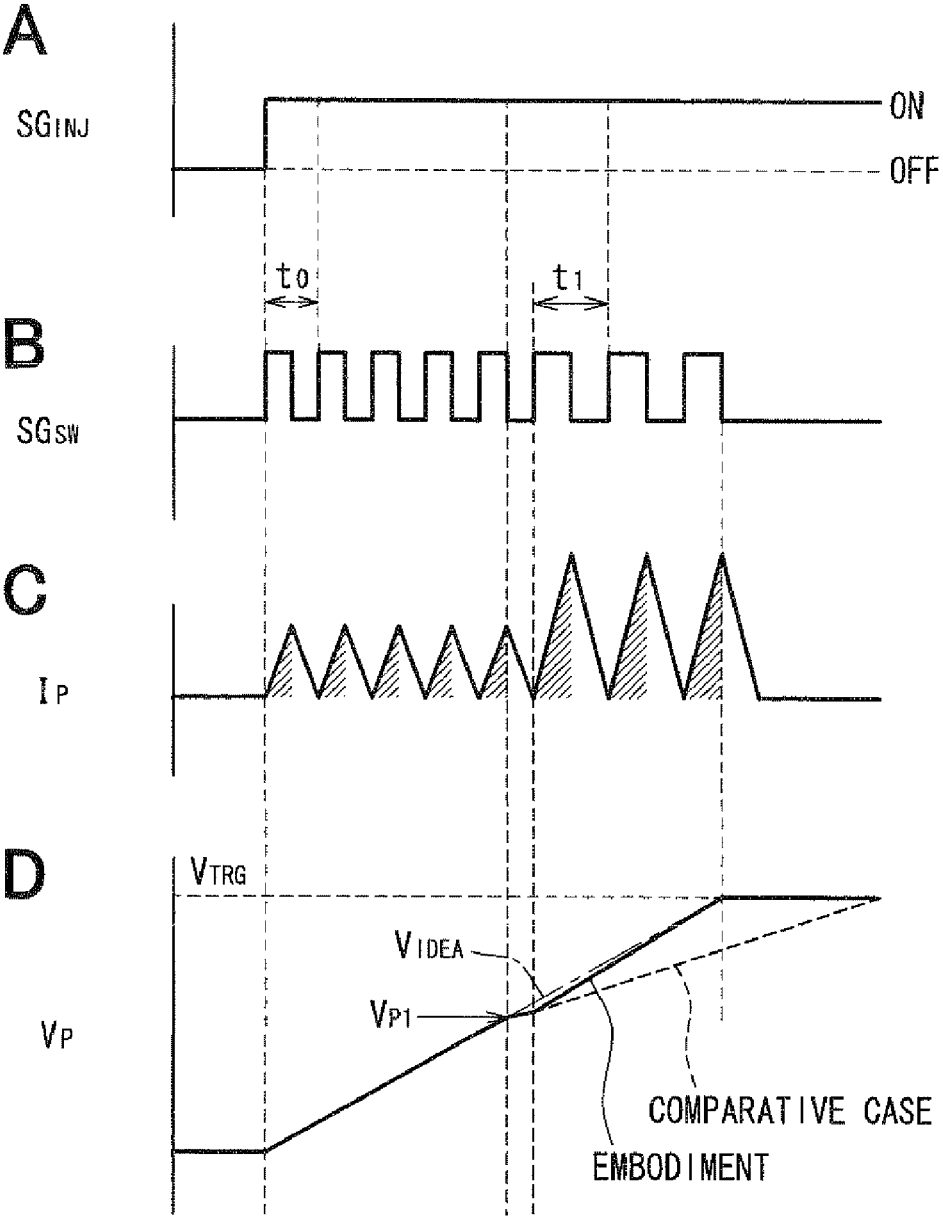
FIGS. 4A to 4D are diagrams for describing the operation of the fuel injection apparatus of the first embodiment at time of valve opening.

FIGS. 4A to 4D show an example of the time chart at the time of valve opening of the fuel injection valve 10, i.e., at the time of charging the piezoelectric actuator 110. Specifically, FIG. 4A indicates the drive signal $SG_{INJ}$, which is outputted from the ECU 21 according to the operational state of the engine to drive the fuel injection valve 10. FIG. 4B indicates the switching signal $SG_{SW}$ that is outputted from the EDU 20, which has received the drive signal $SG_{INJ}$ from the ECU 21, to charge the piezoelectric actuator 110. FIG. 4C indicates the drive current $I_P$, which flows according to the switching signal $SG_{SW}$. FIG. 4D indicates the piezoelectric voltage $V_P$, which is charged in the piezoelectric actuator 110 by the drive current $I_P$.

As shown in FIGS. 4A to 4D, when the fuel injection valve drive signal $SG_{INJ}$, which is outputted from the ECU 21, is placed in the ON-state, the EDU 20 starts the charging of the piezoelectric actuator 110 at the constant pulse period to. When the pulsed current $I_P$ is charged in the superimposed manner, the piezoelectric voltage $V_P$ is increased. When the pressure $P_S$ in the control chamber 160 becomes equal to or larger than the valve opening pressure $P_{OPN}$, the needle 15 begins the valve opening. Then, when the pressure $P_S$ in the control chamber 160 begins to instantaneously decrease, the inflection point $V_{P1}$ is generated on the rising edge of the changing process of the piezoelectric voltage $V_P$. At this time, the pulse period of the charging current $I_P$ is changed from the pulse period t0 to the pulse period t1, and thereby the charging current $I_P$ is increased. Thus, the piezoelectric current $V_P$ is rapidly increased, so that the target voltage $V_{TRG}$ is achieved. According to the present embodiment, in comparison to the previously proposed fuel injection apparatus of the comparative case, in which the charging current is applied at the constant pulse period, the change in the piezoelectric voltage $V_P$ is closer to that of the ideal piezoelectric voltage $V_{IDEA}$.

Figure 5:
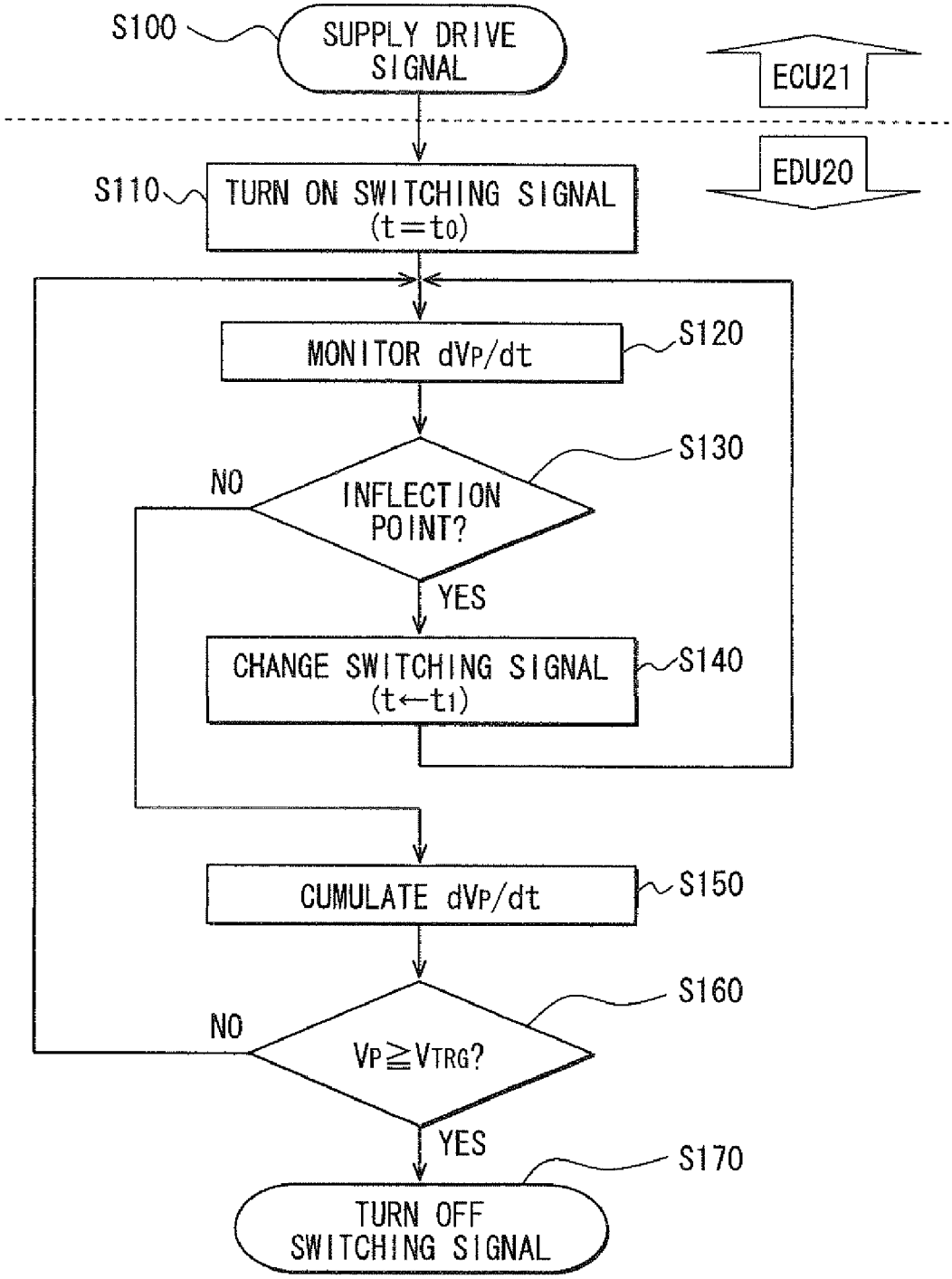
FIG. 5 is a flowchart showing a control operation the fuel injection apparatus according to the first embodiment.

FIG. 5 shows a specific example of the control flowchart indicating the control method of the inflection point sensing arrangement 201 and the charging and discharging condition changing arrangement 202 at the time of the valve opening according to the present embodiment.

At step S100, the drive signal of the fuel injection valve 10 is supplied from the ECU 21 to the EDU 20, so that the fuel injection valve 10 is placed in the driving standby state.

At step S110, the switching signal is placed in the ON-state, and the EDU 20 controls the output of the drive current $I_P$. At this time, the pulse period of the charging current $I_P$, which serves as the charging condition, is set to the initial pulse period to, and the charging of the piezoelectric actuator 110 is started.

At step S120, the short-time change $dV_P/dt$ of the piezoelectric voltage $V_P$, which is charged in the piezoelectric actuator 110, is monitored, i.e., is measured.

At step S130, it is determined whether the inflection point of the piezoelectric voltage exists based on a difference between the target value of $dV_P/dt$ and the actual measured current value of $dV_P/dt$.

When the difference between the target value of $dV_P/dt$ and the actual measured current value of $dV_P/dt$ is relatively large and thereby results in the determination of that the inflection point of the piezoelectric voltage exists (identification of the inflection point) at step S130, control proceeds to step S140.

At step S140, the charging and discharging condition changing arrangement 202 changes the switching signal to have, for example, the second pulse period t1 to compensate the difference between the actual measured current value of $dV_P/dt$ and the target value of $dV_P/dt$, so that the charging current $I_P$ is increased.

Then, control returns to step S120 where the actual measured current value of $dV_P/dt$ is obtained, and thereafter control proceeds to step S130 to determine whether the inflection point of the piezoelectric voltage exists based on a difference between the target value of $dV_P/dt$ and the actual measured current value of $dV_P/dt$.

When the difference between the actual measured current value of $dV_P/dt$ and the target value of $dV_P/dt$ becomes relatively small and thereby results in the determination of that the inflection point of the piezoelectric voltage does not exist at step S130, control proceeds to step S50.

At step S150, the value of $dV_P/dt$ is cumulated, and the piezoelectric voltage $V_P$ of the piezoelectric actuator 110 is computed.

At step S160, it is determined whether the obtained piezoelectric voltage $V_P$ has reached the target voltage $V_{TRG}$.

When it is determined that the obtained piezoelectric voltage $V_P$ has not reached the target voltage $V_{TRG}$ at step S160 (i.e., NO at step S160), control returns to step S120 to maintain the charging of the piezoelectric actuator 110.

Upon repeating of steps S120 to S160, when the piezoelectric voltage $V_P$ has reached the target voltage $V_{TRG}$ (YES at step S160), control proceeds to step S170 where the switching signal is placed in the OFF-state, so that the charging of the piezoelectric actuator 110 is terminated.

At the time of valve closing of the fuel injection valve 10, i.e., at the time of discharging the piezoelectric actuator 110, the corresponding procedure is carried out according to the similar flowchart, which is similar to that of FIG. 5. That is, the short-time change $dV_P/dt$ is monitored. Then, when the inflection point on the falling edge of the piezoelectric voltage $V_P$ is sensed, the discharging pulse period T is changed to increase the discharging current $I_P$ to control the discharging condition until the completion of the discharging. Specifically, the control operation for increasing the discharging pulse period T is executed to decrease the piezoelectric voltage $V_P$, which is increased due to the increase in the pressure $P_S$ in the control chamber 160.

Figure 6:
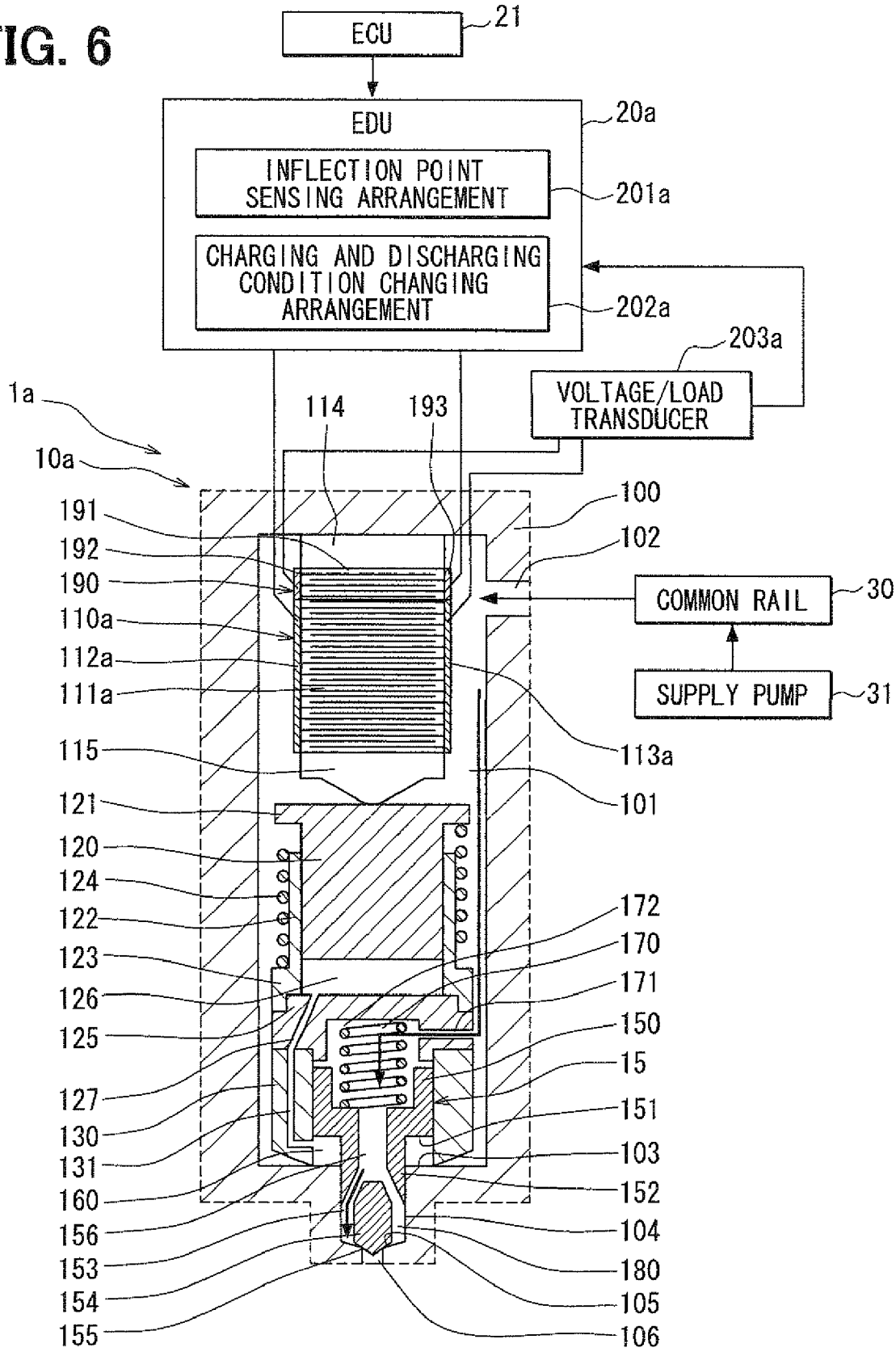
FIG. 6 is a schematic view showing an entire structure of a fuel injection apparatus according to a second embodiment of the present invention.

A fuel injection apparatus 1*a* according to a second embodiment of the present invention will be described with reference to FIG. 6. In the second embodiment as well as the subsequent embodiments, components, which are similar to those of the first embodiment, will be indicated by the same reference numerals and will not be described in detail for the sake of simplicity.

In the first embodiment, the drive voltage measurement circuit, which measures the drive voltage, i.e., the piezoelectric voltage $V_P$ of the piezoelectric actuator 110, is provided as the inflection point sensing arrangement 201. In contrast, according to the second embodiment, with reference to FIG. 6, the inflection point sensing arrangement 201*a* is implemented as the structure, in which a portion of the piezoelectric actuator 110 is used as a pressure sensor 190, which senses the pressure applied to the piezoelectric actuator 110. When the pressure is applied to the pressure sensor 190, the voltage $V_P(a)$ is generated due to the piezoelectric effect. The pressure sensor 190 receives the voltage, which is generated in the piezoelectric element 191, through the lateral surface electrodes 192, 193. This voltage is processed through a conversion circuit (voltage/load transducer) 203*a* to undergo the load conversion. The information, which is outputted from the conversion circuit 203*a*, is monitored by the EDU 20*a* as the information, which indirectly indicates the change in the pressure $P_S$ in the control chamber 160. Based on this information, the charging and discharging condition changing arrangement 202*a* compensates the influences of the change in the pressure $P_S$ in the control chamber 160.

The pressure sensor 190 may be considered as a load sensor that measures a load (the pressure) on the piezoelectric actuator 110. In such a case, the inflection point sensing arrangement 201*a* may compute a current value of a short-time change (a temporal derivative) $dV_L/dt$ of a load voltage $V_L$ based on the load voltage $V_L$, which is generated due to a piezoelectric effect of the load sensor (the pressure sensor 190). Then, the inflection point sensing arrangement 201*a* may sense, i.e., identify the inflection point based on a difference between the current value of the short-time change $dV_L/dt$ and a target value of the short-time change $dV_L/dt$.

Figure 7:
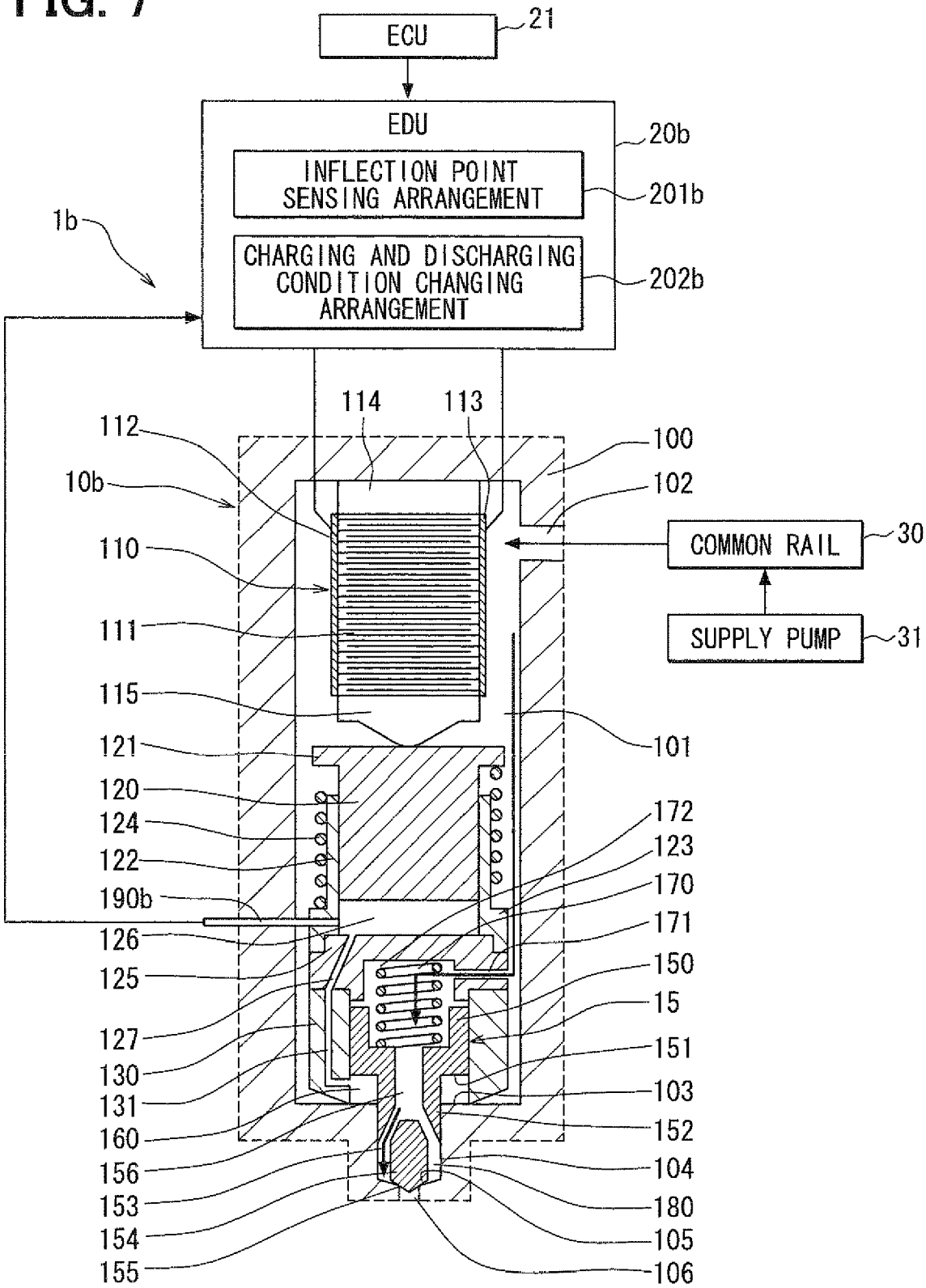
FIG. 7 is a schematic view showing an entire structure of a fuel injection apparatus according to a third embodiment of the present invention.

An entire structure of a fuel injection apparatus 1*b* according to a third embodiment of the present invention will be described with reference to FIG. 7. In the present embodiment, a pressure sensor 190*b* is provided in the pressurizing chamber 126 to directly measure the pressure $P_S$ in the control chamber 160.

Figure 8A:
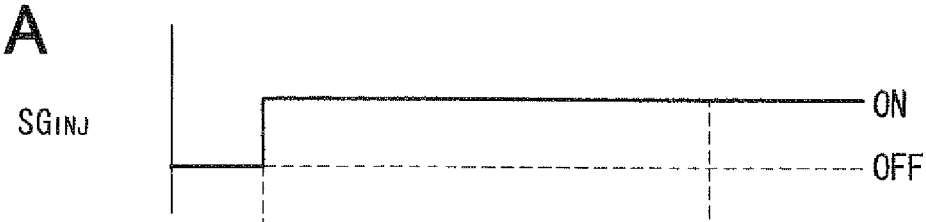
FIGS. 8A to 8D are diagrams for describing an operation of the fuel injection apparatus of the third embodiment at time of valve opening.
Figure 8B:
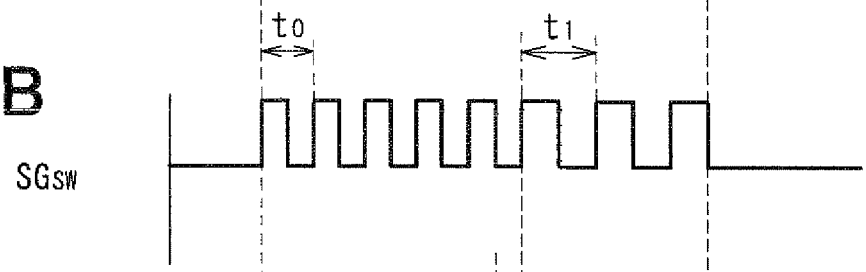
Figure 8C:
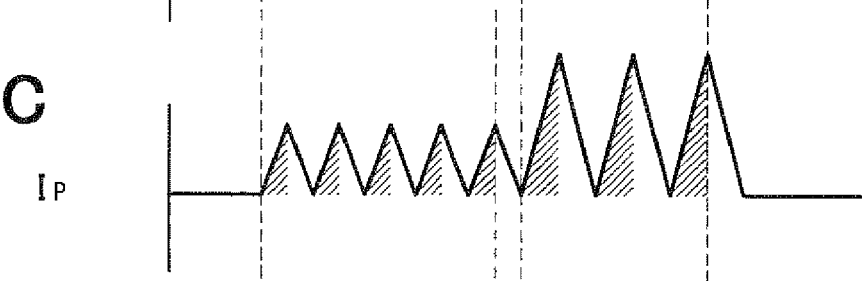
Figure 8D:
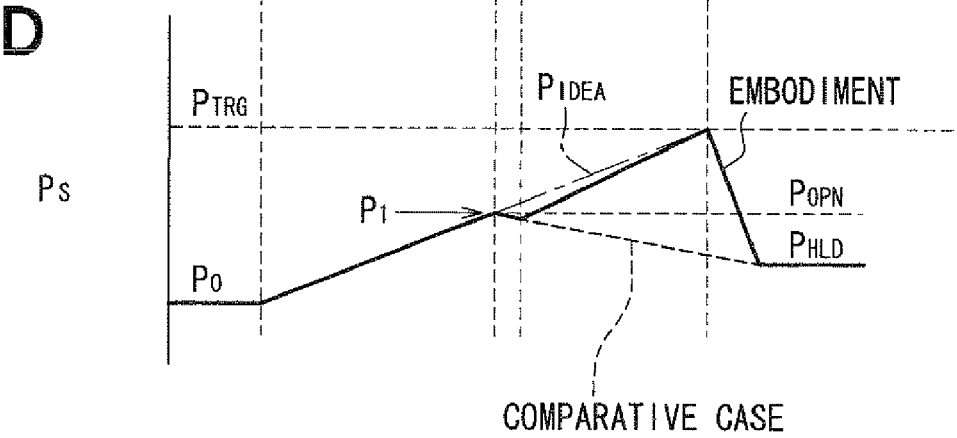

FIGS. 8A to 8D show an example of the time chart at the time of valve opening of the fuel injection valve 10*b*. Specifically, FIG. 8A indicates the drive signal $SG_{INJ}$, which is outputted from the ECU 21*b* according to the operational state of the engine to drive the fuel injection valve 10*b*. FIG. 8B indicates the switching signal $SG_{SW}$ that is outputted from the EDU 20*b*, which has received the drive signal $SG_{INJ}$ from the ECU 21, to charge the piezoelectric actuator 110. FIG. 8C indicates the drive current $I_P$, which flows according to the switching signal $SG_{SW}$. FIG. 8D indicates the pressure $P_S$ in the control chamber 160.

As shown in FIGS. 8A to 8D, when the fuel injection valve drive signal $SG_{INJ}$, which is outputted from the ECU 21*b*, is placed in the ON-state, the EDU 20*b* starts the charging of the piezoelectric actuator 110 at the constant pulse period to. When the pressure $P_S$ in the control chamber 160 becomes equal to or larger than the valve opening pressure $P_{OPN}$, the needle 15 begins to move upward to open the injection hole 106. Then, when the pressure $P_S$ in the control chamber 160 is instantaneously decreased, the inflection point P1 is generated on the rising edge of the measured pressure $P_S$ in the control chamber 160 to deviate from the ideal pressure $P_{IDEA}$. At this time, the pulse period of the charging current $I_P$ is changed from the pulse period t0 to the pulse period t1, and thereby the charging current $I_P$ is increased. Thus, the decreasing of the expansion speed of the piezoelectric actuator 110 is compensated. As a result, the pressure $P_S$ in the control chamber 160 is rapidly increased and thereby reaches the target pressure $P_{TRG}$.

Figure 9:
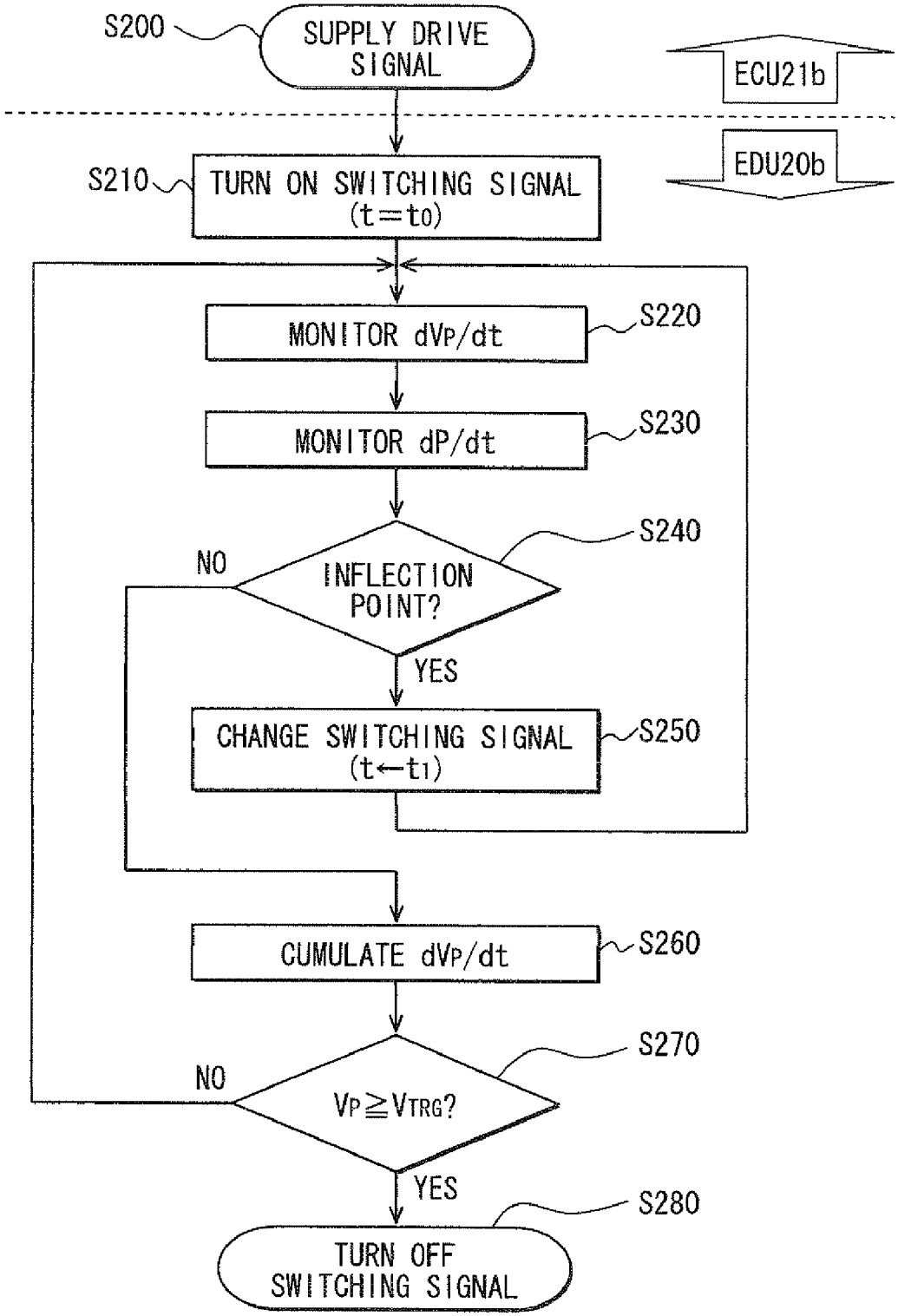
FIG. 9 is a flowchart showing a control operation of the fuel injection apparatus according to the third embodiment.
Figures 10A, 10B, 10C, 10D:
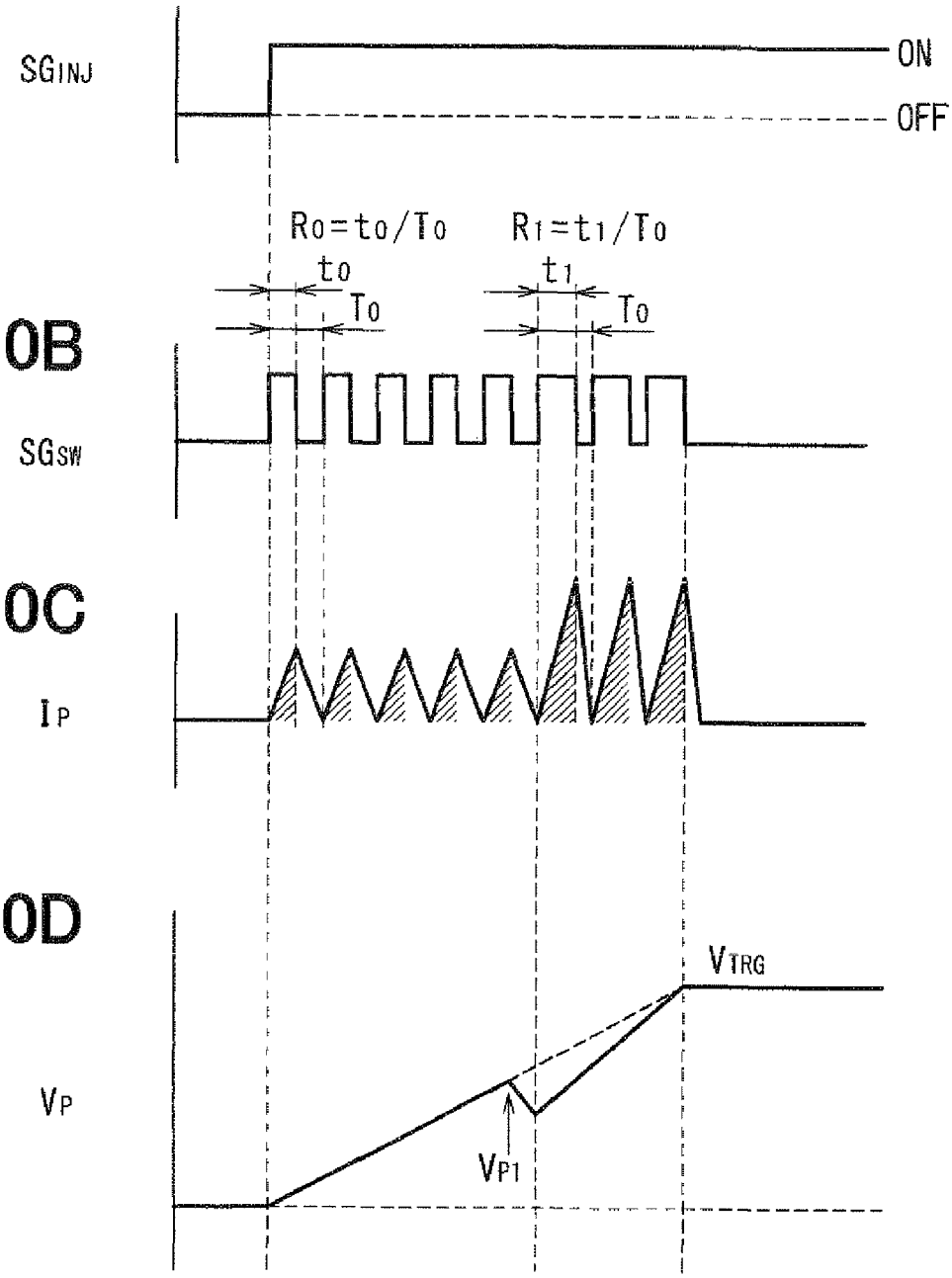
FIGS. 10A to 10D are diagrams for describing an operation of a fuel injection apparatus according to a fourth embodiment of the present invention.

FIG. 9 shows a specific example of the control flowchart indicating the control method at the time of valve opening according to the third embodiment.

At step S200, the drive signal of the fuel injection valve 10*b* is supplied from the ECU 21*b* to the EDU 20*b*, so that the fuel injection valve 10*b* is placed in the driving standby state.

At step S210, the switching signal is placed in the ON-state, and the EDU 20*b* controls the output of the drive current $I_P$. At this time, the pulse period of the charging current $I_P$, which serves as the charging condition, is set to the initial pulse period t0, and the charging of the piezoelectric actuator 110*b* is started.

At step S220, the short-time change $dV_P/dt$ of the piezoelectric voltage $V_P$, which is charged in the piezoelectric actuator 110*b*, is monitored, i.e., is measured.

At step S230, the short-time change dP/dt of the pressure $P_S$ in the control chamber 160 is monitored, i.e., is measured.

At step S240, it is determined whether the inflection point of the piezoelectric voltage exists based on a difference between the target value of dP/dt and the actual measured current value of dP/dt.

When the difference between the actual measured current value of dP/dt and the target value of dP/dt is relatively large and thereby results in the determination of that the inflection point on the rising edge of the pressure $P_S$ in the control chamber 160 exists at step S240, control proceeds to step S250.

At step S250, the charging and discharging condition changing arrangement 202*b* changes the switching signal to have, for example, the second pulse period t1 to compensate the difference between the actual measured current value of dP/dt and the target value of dP/dt, so that the charging current $I_P$ is increased.

Then, control returns to steps S220, S230 to obtain the measured value of $dV_P/dt$ and the measured value of dP/dt, respectively. Thereafter, at step S240, it is determined whether the inflection point of the piezoelectric voltage exists based on the difference between the target value of dP/dt and the actual measured current value of dP/dt one again.

When the difference between the actual measured current value of dP/dt and the target value of dP/dt becomes relatively small and thereby results in the determination of that the inflection point on the rising edge of the pressure $P_S$ in the control chamber 160 does not exist at step S240, control proceeds to step S260.

At step S260, the value of $dV_P/dt$ is cumulated, and the piezoelectric voltage $V_P$ of the piezoelectric actuator 110 is computed.

At step S270, it is determined whether the obtained piezoelectric voltage $V_P$ has reached the target voltage $V_{TRG}$.

When it is determined that the obtained piezoelectric voltage $V_P$ has not reached the target voltage $V_{TRG}$ at step S270, control returns to step S220 to maintain the charging of the piezoelectric actuator 110.

Upon repeating of steps S220 to S270, when the piezoelectric voltage $V_P$ has reached the target voltage $V_{TRG}$, control proceeds to step S280 where the switching signal is placed in the OFF-state, so that the charging of the piezoelectric actuator 110 is terminated.

At the time of valve closing of the fuel injection valve 10*b*, i.e., at the time of discharging the piezoelectric actuator 110*b*, the corresponding procedure is carried out according to the similar flowchart, which is similar to that of FIG. 9. That is, the short-time change $dV_P/dt$ and the short time change dP/dt are monitored. Then, when the inflection point on the failing edge of the pressure $P_S$ in the control chamber 160 is sensed, the discharging pulse period T is changed to increase the discharging current $I_P$ to control the discharging condition until the completion of the discharging. Specifically, the control operation for increasing the discharging pulse period T is executed to decrease the piezoelectric voltage $V_P$, which is increased due to the increase in the pressure $P_S$ in the control chamber 160.

The third embodiment may be modified as follows. That is, the monitoring step of monitoring the short-time change $dV_P/dt$ may be eliminated, and thereby only the monitoring step of monitoring the short-time change dP/dt may be executed. In such a case, instead of cumulating the value of $dV_P/dt$, the value of dP/dt may be cumulated. Then, when the pressure $P_S$ in the control chamber 160 reaches the target pressure $P_{TRG}$, the switching signal may be placed in the OFF-state.

Figure 11:
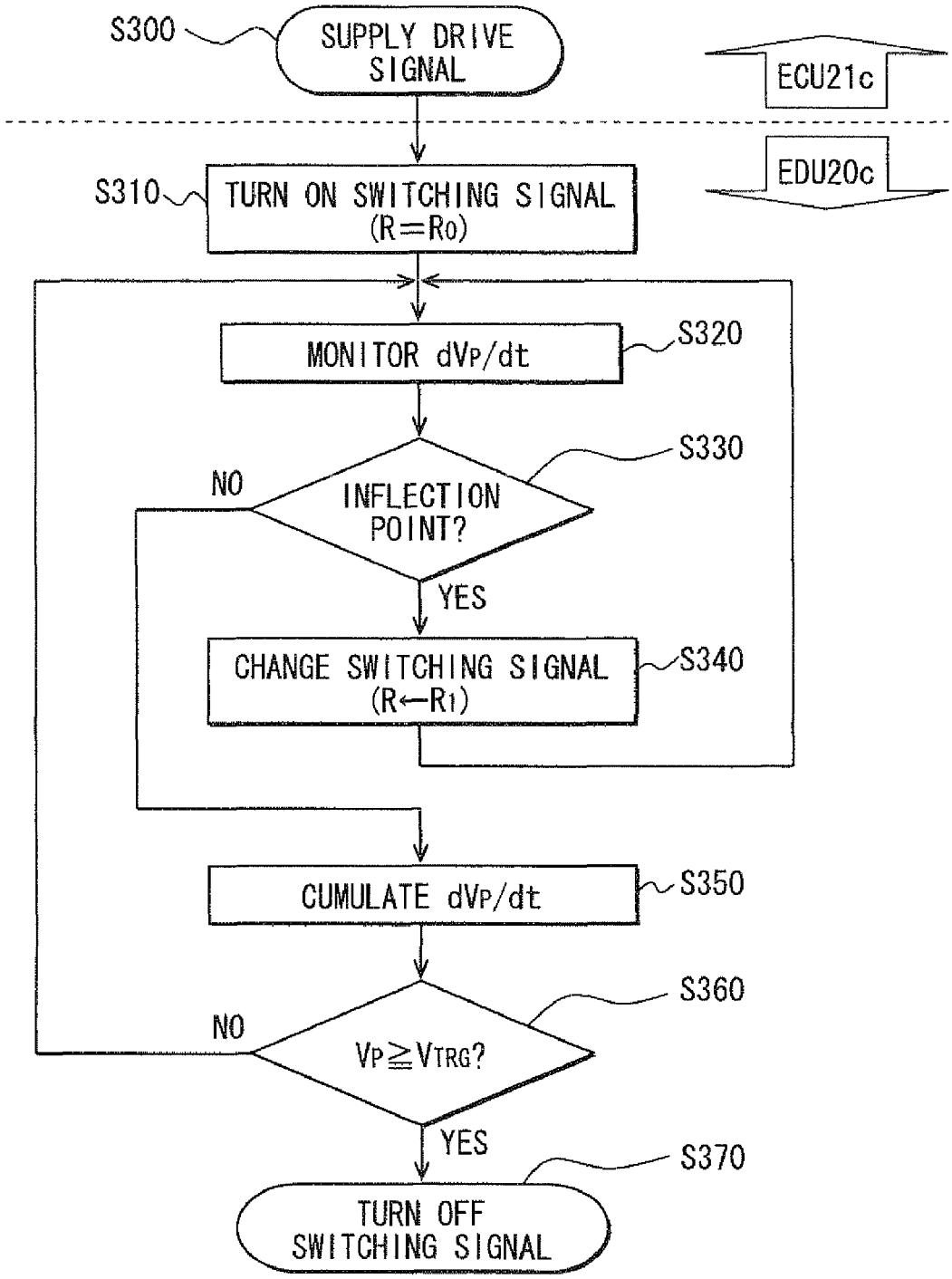
FIG. 11 is a flowchart showing a control operation of the fuel injection apparatus according to the fourth embodiment.

FIGS. 10A to 10D show a specific example of the control flowchart indicating the control method of the inflection point sensing arrangement 201 and the charging and discharging condition changing arrangement 202 at the time of the valve opening according to a fourth embodiment of the present invention. FIG. 11 shows a specific example of the control flowchart indicating the control method of the inflection point sensing arrangement 201 and the charging and discharging condition changing arrangement 202 at the time of the valve opening according to the fourth embodiment.

In the above embodiments, the charging and discharging condition changing arrangement 202, 202*a*, 202*b* changes the charging current or the pulse period of the discharging current to increase or decrease the discharging voltage. In contrast, according to the present embodiment, as shown in FIGS. 10A to 10D and 11, there is executed a pulse width modulation (PWM) control operation. In the PWM control operation, while the pulse period is kept constant, the duty ratio of a charging pulse of the charging current or a discharging pulse of the discharging current is increased or decreased to increase or decrease the charging voltage or discharging voltage.

In the present embodiment, the flowchart, which is similar to the control flowchart of the above embodiments, may be used. The flowchart of the present embodiment differs from that of the above embodiments for the following points. That is, as the initial setting, at step S310, the initial value of the duty ratio R is set to R0=t0/T0. Then, at step S340, instead of changing the switching pulse period T, the duty ratio R at the time of valve opening is changed to, for example, R1=t1/T0.

Through the pulse width modulation, the increasing or decreasing of the charging voltage or the discharging voltage is executed. Thus, the piezoelectric voltage $V_P$, which is generated due to the piezoelectric effect upon the pressure change, is rapidly modified to the desired value.

Thus, similar to the above embodiments, according to the present embodiment, there is implemented the fuel injection apparatus, which shows the good response and the good fuel injection accuracy.

Furthermore, the charging and discharging condition changing arrangement may execute a combination of the changing of the switching pulse period and the changing of the duty ratio.

Furthermore, in order to limit the bounce movement of the needle 15 at the time of valve closing, it is possible to execute a control operation, which reduces the discharging pulse period T immediately before the seating of the seat surface 155 of the valve element 154 against the inner peripheral wall of the valve seat 105, or to execute a control operation, which reduces the duty ratio R of the discharging pulse. In this way, the drive speed of the needle 15 is slowed down immediately before the seating of the needle 15, so that the bounce movement of the needle 15 can be limited.

The present invention is not limited to the above embodiments. That is, the above embodiments may be modified within the scope of the present invention, in which the pressure change in the control chamber is sensed, and the drive current of the piezoelectric actuator is feedback controlled to compensate the influences of the piezoelectric effect generated in the piezoelectric actuator due to the pressure change in the control chamber.

For example, the present invention is not limited to the structure of the fuel injection valve discussed in the above embodiments, in which the high pressure fuel is supplied to the fuel accumulation chamber through the needle internal flow passage that is formed in the needle. For instance, the present invention may be applied to a fuel injection valve that has a structure, in which the high pressure fuel is directly supplied into the fuel accumulation chamber. Furthermore, the present invention is not limited to the fuel injection valve discussed in the above embodiments, in which the single injection hole is opened or closed. For instance, the present invention may be applied to a fuel injection valve, in which the distal end of the nozzle is closed, and a sack chamber is provided to accumulate the fuel while a plurality of injection holes extend through the wall of the sack chamber.

Additional advantages and modifications will readily occur to those skilled in the art. The invention in its broader terms is therefore not limited to the specific details, representative apparatus, and illustrative examples shown and described.

What is claimed is:

1. A fuel injection apparatus comprising:

a nozzle that has a fuel injection hole, which extends through a wall of a distal end portion of the nozzle, and a valve seat, which surrounds an inlet of the fuel injection hole;

a needle that has a valve element at a distal end side of the needle and is axially reciprocable in a first axial direction and an opposite second axial direction relative to the valve seat;

a control chamber that receives pressure conducting fluid, which exerts a pressure to the needle to axially drive the needle;

a piezoelectric actuator that expands and contracts depending on a drive voltage thereof, which is increased and is decreased through charging of electric current to the piezoelectric actuator and discharging of electric current from the piezoelectric actuator, respectively, wherein one of expansion and contraction of the piezoelectric actuator results in an increase in the pressure of the pressure conducting fluid in the control chamber to axially move the needle in the first axial direction away from the valve seat, and the other one of the expansion and the contraction of the piezoelectric actuator results in a decrease in the pressure of the pressure conducting fluid in the control chamber to axially move the needle in the second axial direction toward the valve seat;

an inflection point sensing means for sensing an inflection point in a pressure-changing process of the pressure in the control chamber; and a charging and discharging condition changing means for changing a charging condition for the charging of the electric current to the piezoelectric actuator or a discharging condition for the discharging of the electric current from the piezoelectric actuator upon sensing of the inflection point, which is sensed with the inflection point sensing means.

2. The fuel injection apparatus according to claim 1, wherein:

the inflection point sensing means includes a voltage measurement circuit that measures a piezoelectric voltage $V_P$, which serves as the drive voltage and is generated in the piezoelectric actuator;

the inflection point sensing means computes an actual value of a temporal derivative $dV_P/dt$ of the piezoelectric voltage $V_P$ based on the piezoelectric voltage $V_P$, which is measured with the voltage measurement circuit; and the inflection point sensing means identifies the inflection point based on a difference between the actual value of the temporal derivative $dV_P/dt$ and a target value of the temporal derivative $dV_P/dt$.

3. The fuel injection apparatus according to claim 1, wherein:

the inflection point sensing means includes a pressure sensor that measures the pressure $P_S$ in the control chamber;

the inflection point sensing means computes an actual value of a temporal derivative $dP_S/dt$ of the pressure $P_S$ in the control chamber based on the pressure $P_S$ in the control chamber, which is measured with the pressure sensor; and the inflection point sensing means identifies the inflection point based on a difference between the actual value of the temporal derivative $dP_S/dt$ and a target value of the temporal derivative $dP_S/dt$.

4. The fuel injection apparatus according to claim 1, wherein:

a portion of the piezoelectric actuator forms a load sensor that measures a load on the piezoelectric actuator;

the inflection point sensing means computes an actual value of a temporal derivative $dV_L/dt$ of a load voltage $V_L$ based on the load voltage $V_L$, which is generated due to a piezoelectric effect of the load sensor; and the inflection point sensing means identifies the inflection point based on a difference between the actual value of the temporal derivative $dV_L/dt$ and a target value of the temporal derivative $dV_L/dt$.

5. The fuel injection apparatus according to claim 1, wherein the charging and discharging condition changing means increases or decreases a charging pulse period of the electric current, which is charged to the piezoelectric actuator and serves as the charging condition, or a discharging pulse period of the electric current, which is discharged from the piezoelectric actuator and serves as the discharging condition.

6. The fuel injection apparatus according to claim 5, wherein the charging and discharging condition changing means increases the charging pulse period to increase the drive voltage of the piezoelectric actuator, which is reduced due to a reduction in the pressure in the control chamber in an operational time period of lifting the valve element from the valve seat.

7. The fuel injection apparatus according to claim 5, wherein the charging and discharging condition changing means increases the discharging pulse period to decrease the drive voltage of the piezoelectric actuator, which is increased due to an increase in the pressure in the control chamber in an operational time period of seating the valve element against the valve seat.

8. The fuel injection apparatus according to claim 5, wherein the charging and discharging condition changing means reduces the discharging pulse period immediately before seating of the valve element against the valve seat.

9. The fuel injection apparatus according to claim 1, wherein the charging and discharging condition changing means increases or decreases a duty ratio of a charging pulse of the electric current, which is charged to the piezoelectric actuator and serves as the charging condition, or a discharging pulse the electric current, which is discharged from the piezoelectric actuator and serves as the discharging condition, through pulse width modulation.

10. The fuel injection apparatus according to claim 9, wherein the charging and discharging condition changing means increases the duty ratio of the charging pulse to increase the drive voltage of the piezoelectric actuator, which is reduced due to a reduction in the pressure in the control chamber in an operational time period of lifting the valve element from the valve seat.

11. The fuel injection apparatus according to claim 9, wherein the charging and discharging condition changing means increases the duty ratio of the discharging pulse to reduce the drive voltage of the piezoelectric actuator, which is increased due to an increase in the pressure in the control chamber in an operational time period of seating the valve element against the valve seat.

12. The fuel injection apparatus according to claim 9, wherein the charging and discharging condition changing means reduces the duty ratio of the discharging pulse immediately before seating of the valve element against the valve seat.

* * * * *